US005971180A

United States Patent [19]

Wu

[11] Patent Number: 5,971,180

[45] Date of Patent: Oct. 26, 1999

[54] SEALING PLUG CAP FOR A SEALING CONTAINER

[76] Inventor: Mao Sheng Wu, No. 42-21, Peidao Li, Tanshui Chen, 251 Taipei, Taiwan

[21] Appl. No.: 09/145,246

[22] Filed: Sep. 2, 1998

[51] Int. Cl.[6] ..... B65D 39/00; B65D 51/16

[52] U.S. Cl. ..... 215/228; 215/262; 215/311; 215/355; 220/203.04; 220/203.28; 220/231

[58] Field of Search ..... 215/228, 262, 215/311, 307, 355, 270; 220/203.01, 203.04, 203.07, 203.28, 212, 231, 240, 360, 367.1, 371, 373; 137/522, 526; 141/65, 66; 417/545, 547; 99/472

[56] References Cited

U.S. PATENT DOCUMENTS 5,465,857 11/1995 Yang ..... 215/228
5,535,900 7/1996 Huang ..... 215/228
5,653,352 8/1997 Kim ..... 215/228
5,735,317 4/1998 Wu ..... 141/65

*Primary Examiner*—Stephen Castellano
*Assistant Examiner*—Niki M. Eloshway
*Attorney, Agent, or Firm*—Rosenberg, Klein & Bilker

[57] ABSTRACT

A sealing plug cap includes a plug cap body fastened to the mouth of a sealing container to seal the passage of the mouth by a deformatable peripheral flap thereof, an air buffer device fastened to the bottom end of the plug cap body inside the sealing container to buffer the speed of air passing through a center air hole on the plug cap body, a socket mounted inside the plug cap body, and a sealing and relief control unit mounted in the socket, the sealing and relief control unit being forced by atmospheric pressure to close the air hole on the plug cap body when a suction pump is used to draw air out of the sealing container, the sealing and relief control unit being forced to open the air hole on the plug cap body when depressed.

1 Claim, 7 Drawing Sheets

SEALING PLUG CAP FOR A SEALING CONTAINER

BACKGROUND OF THE INVENTION

The present invention relates to a sealing plug cap for sealing the mouth of a sealing container, and more particularly to such a sealing plug cap which has air buffer means to buffer the flowing speed of air when the air passage through the mouth of the sealing container is opened.

A sealing container can be processed into a vacuum status so that contained matter can be kept fresh for long. A sealing container is generally sealed with a sealing plug cap to which a suction pump can be attached and operated to draw air out of the container. FIG. 1 shows a prior art sealing plug cap fastened to the mouth 104 of a sealing container 100 to seal the container 100. The sealing plug cap comprises plug cap body 101, and a plug rod 102 downwardly extended from the plug cap body 101. The plug rod 102 has serrated portions 103 raised around the periphery for positive positioning in the mouth 104 of the sealing container 100. When installed, a suction pump is used to draw air out of the container, enabling the container to be maintained in a vacuum status. This structure of sealing plug cap is still not satisfactory in function. When the sealing plug cap is depressed to open the air passage, a rush flow of air suddenly passes to the inside of the container, causing contained liquid to splash.

SUMMARY OF THE INVENTION

A sealing plug cap according to the preferred embodiment of the present invention comprises a plug cap body molded from flexible material and fastened to the mouth of a sealing container, the plug cap body comprising a bowl stopped above the mouth of the sealing container, a plug rod raised from the bowl and plugged into the mouth of the sealing container, a peripheral flap raised around the periphery of the plug rod and stopped outside the mouth of the sealing container, an annular groove inside the bowl, a cone raised from the center of the bowl on the inside, and an air hole pierced through the center of the cone and the longitudinal central axis of the plug rod; a socket fitted into the bowl of the plug cap body, the socket comprising a positioning flange raised around the periphery on the middle and engaged into the annular groove inside the bowl, and a circular bottom hole at the center, which receives the cone of the plug cap body; an air buffer device fastened to the plug rod of the plug cap body inside the sealing container, the air buffer device comprising a retainer element, the retainer element comprising a disk-like head suspended inside the sealing container and a peripherally serrated split rod perpendicularly raised from the center of the disk-like head and engaged into the air hole in the plug rod of the plug cap body, and an annular sponge mounted around the split rod of the retainer element and stopped between the plug rod of the plug cap body and the disk-like head of the retainer element; and a sealing and relief control unit mounted within the socket, the sealing and relief control unit comprising a sealing plate suspended inside the socket and supported on the cone of the plug cap body to seal the air hole, and a press block mounted inside the socket and operated to tilt the sealing plate in opening the air hole, the press block comprising a lever suspended in an opening thereon, the lever comprising an actuating rod downwardly raised from a free end thereof and aimed at the sealing plate. The sealing plate of the sealing and relief control unit is forced by atmospheric pressure to close the air hole on the plug cap body when a suction pump is used to draw air out of the sealing container. When air is drawn away from the sealing container, the peripheral flap curved inwards and engaging the mouth of the container to seal the gap and to keep the container in a vacuum status. Therefore, the user can check the air tight condition of the sealing container by means of visually inspecting the shape change of the peripheral flap. The sealing plate is tilted by the actuating rod to open the air hole on the plug cap body, enabling the inside air pressure of the sealing container to be balanced with the atmospheric pressure when the lever of the sealing and relief control unit is depressed to lower the actuating rod.

DESCRIPTION OF THE REFERENCE NUMBERS

| | |
|---|---|
| 1 | plug cap body |
| 2 | socket |
| 3 | air buffer device |
| 11 | bowl |
| 21 | positioning flange |
| 11a | annular groove |
| 11b | cone |
| 11c | air hole |
| 12 | plug rod |
| 12a | peripheral flap |
| 200 | sealing container |
| 200a | mouth |
| 31 | annular sponge |
| 32 | retainer element |
| 321 | disk-like head |
| 322 | split rod |
| 4 | relief control unit |
| 41 | press block |
| 42 | sealing plate |
| 41a | lever |
| 41b | tilting rod |

DETAILED DESCRIPTION OF THE PREFERRED EMBODIMENT

Figure 1:
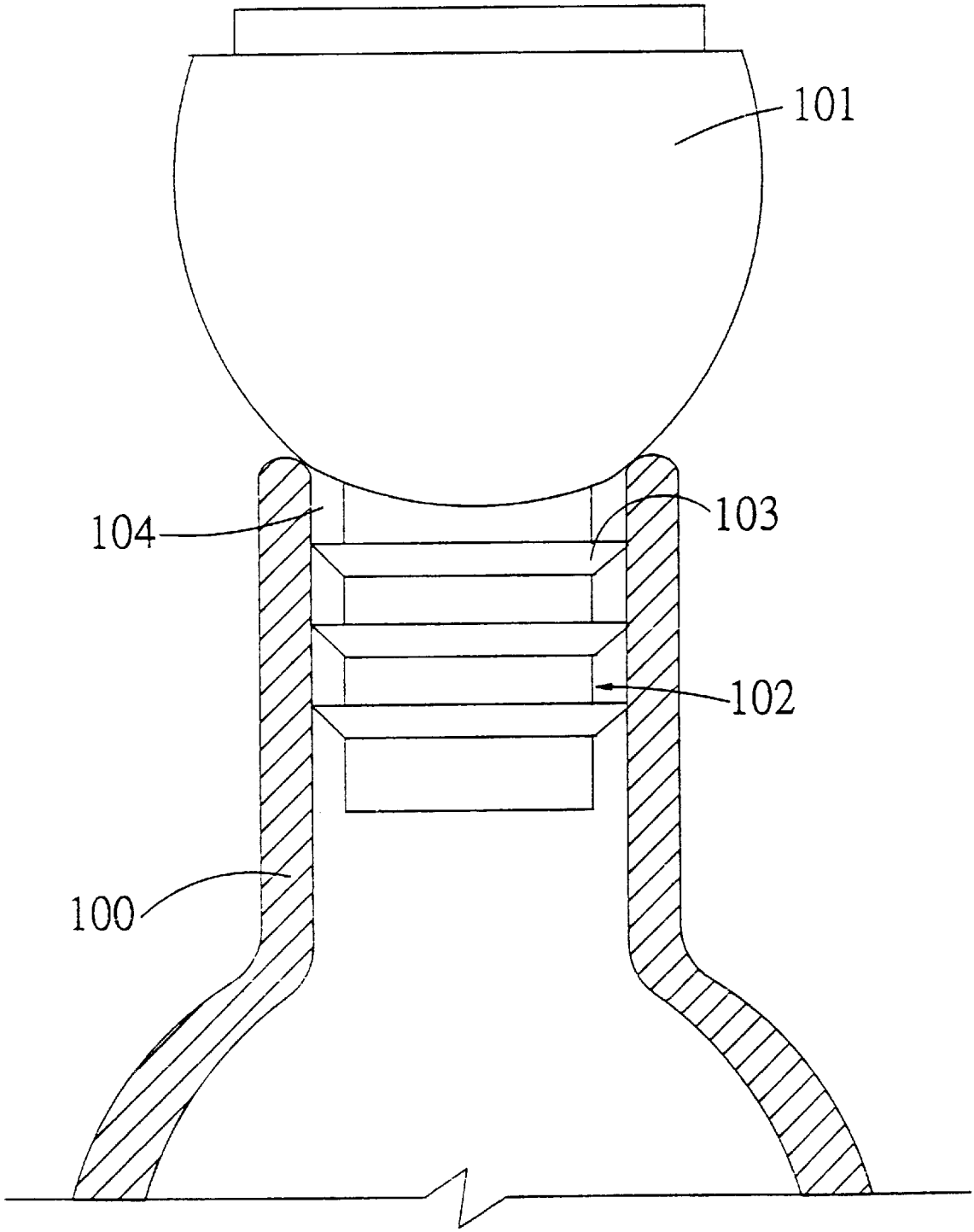
FIG. 1 Prior art
FIG. 1 illustrates a sealing plug cap fastened to the mouth of a sealing container to seal the air passage according to the prior art.
Figure 2:
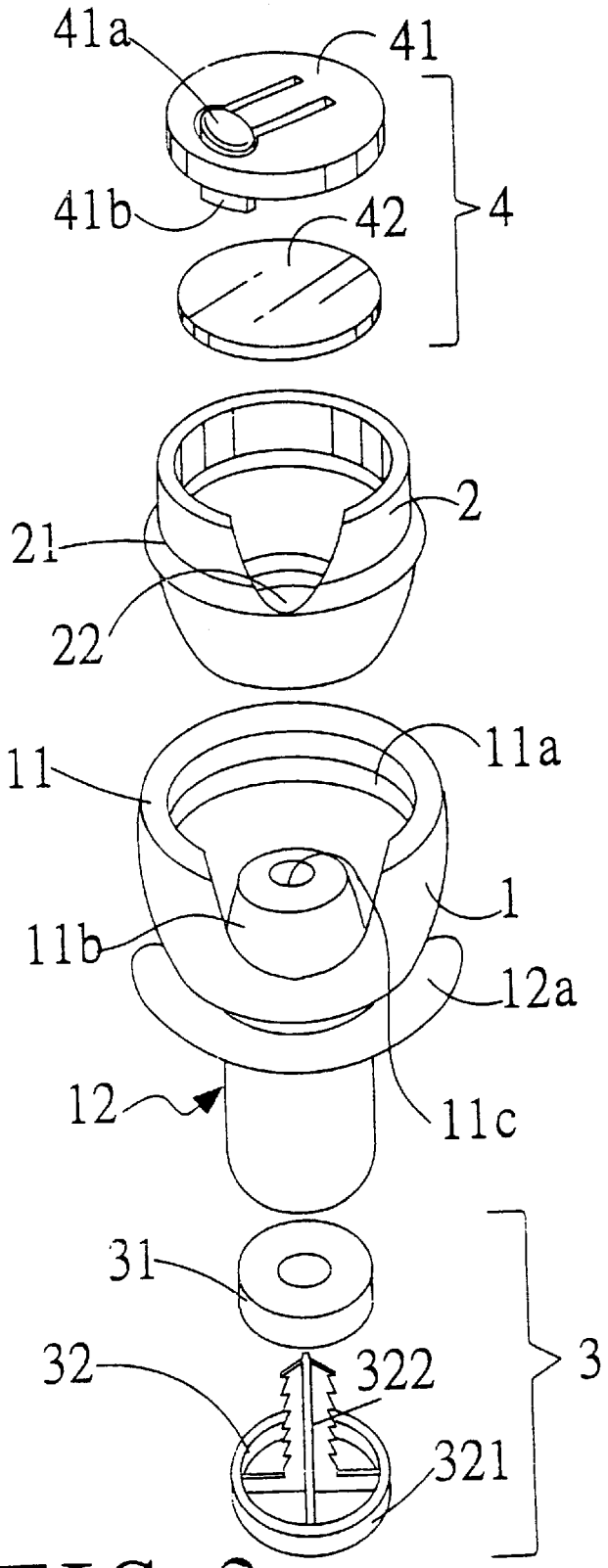
FIG. 2 is an exploded view of a sealing plug cap according to the present invention.
Figure 3:
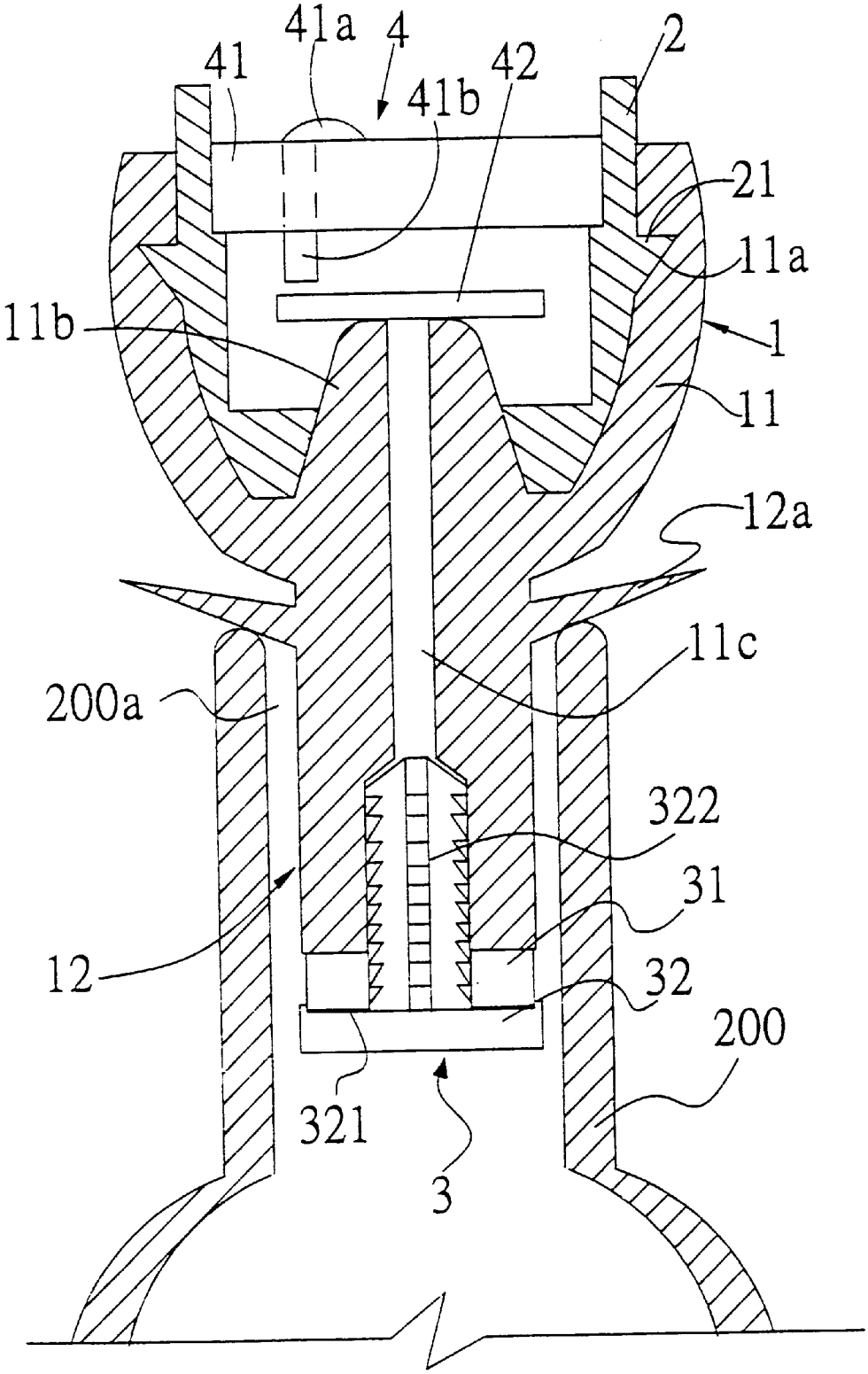
FIG. 3 is a sectional view showing the sealing plug cap fastened to the mouth of a sealing container according to the present invention.

Referring to FIGS. 2 and 3, a sealing plug cap in accordance with the present invention is generally comprised of a plug cap body 1, a socket 2, air buffer device 3, and a sealing and relief control unit 4.

The plug cap body 1 is molded from flexible material and shaped like a hopper, comprising a bowl 11 at the top, a plug rod 12 at the bottom, a peripheral flap 12*a* raised around the periphery of the plug rod 12 near the bowl 11, an annular groove 11*a* around the inside wall of the bowl 11 near the top, a cone 11*b* raised from the center of the inside wall of bowl 11, and an axially extended air hole 11*c* pierced through the center of the cone 11*b* and the longitudinal central axis of the plug rod 12. When the plug rod 12 of the plug cap body 1 is plugged into the mouth (bottle neck) 200*a* of a sealing container 200, the peripheral flap 12*a* is stopped outside the mouth 200*a* to seal the gap. The socket 2 fits the inside wall of the bowl 11 of the plug gap body 1, having a positioning flange 21 raised around the periphery on the middle and engaged into the annular groove 11*a* inside the bowl 11, and a circular bottom hole 22 at the center, which receives the cone 11*b* of the plug cap body 1. The air buffer device 3 comprises an annular sponge 31, and a retainer element 32. The retainer element 32 comprises a disk-like head 321, and a peripherally serrated split rod 322 perpendicularly raised from the center of the disk-like head 321. The peripherally serrated split rod 322 of the retainer bolt 32 is engaged into the air hole 11*c* to secure the annular sponge 31 to the end edge of the plug rod 12. The sealing and relief control unit 4 is mounted within the socket 2, and comprised of a press block 41 and a sealing plate 42. The press block 41 comprises a lever 41*a* suspended in an opening thereon. The lever 41*a* comprises an actuating rod 41*b* downwardly raised from the free end thereof. When assembled, the sealing plate 42 is supported on the cone 11*b* inside the socket 2 to close the air hole 11*c,* and the actuating rod 41*b* is aimed at the border area of the top side wall of the sealing plate 42.

Figure 4:
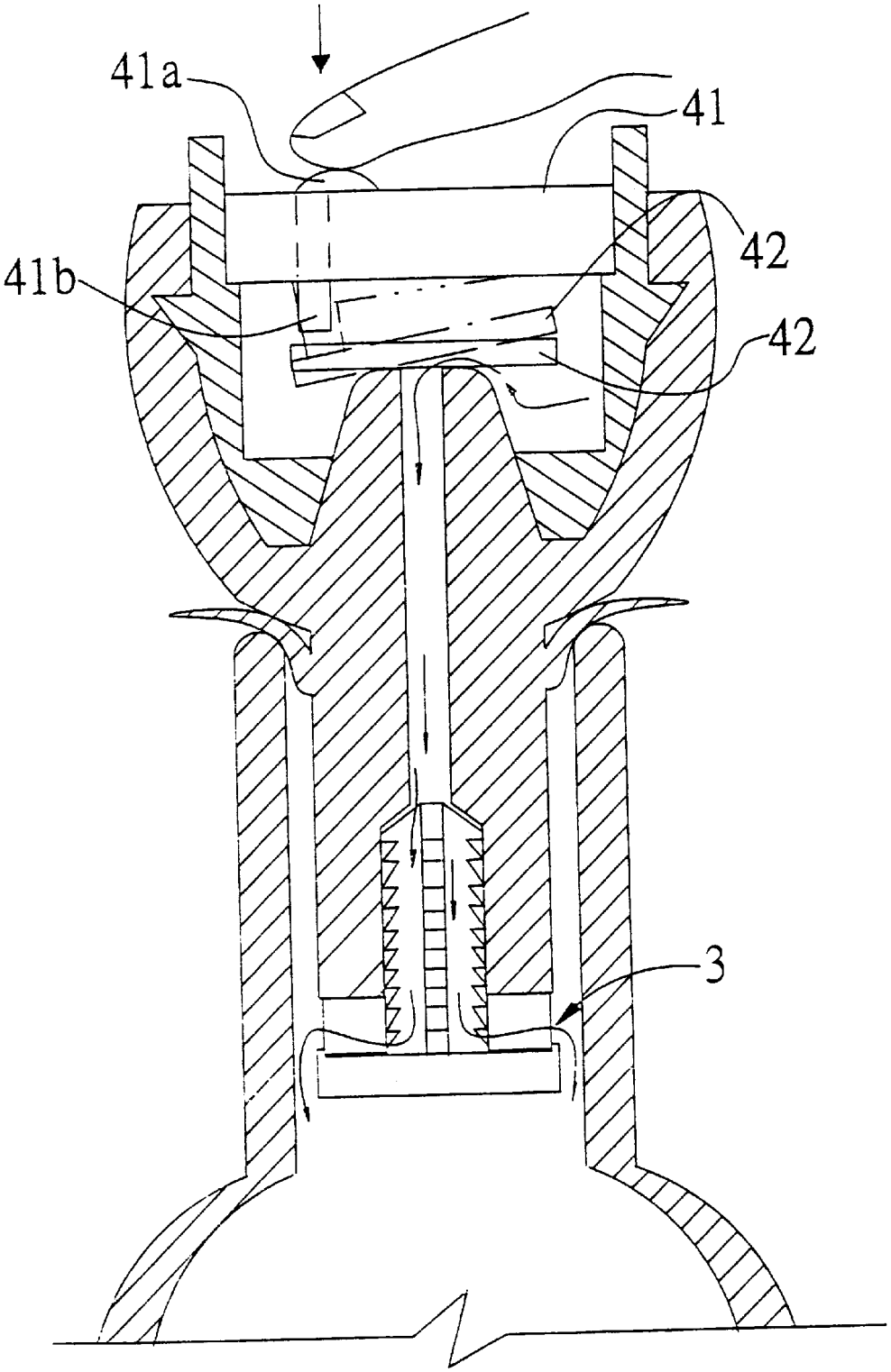
FIG. 4 is another sectional view of the present invention, showing the lever depressed, the sealing plate tilted.
Figure 4A:
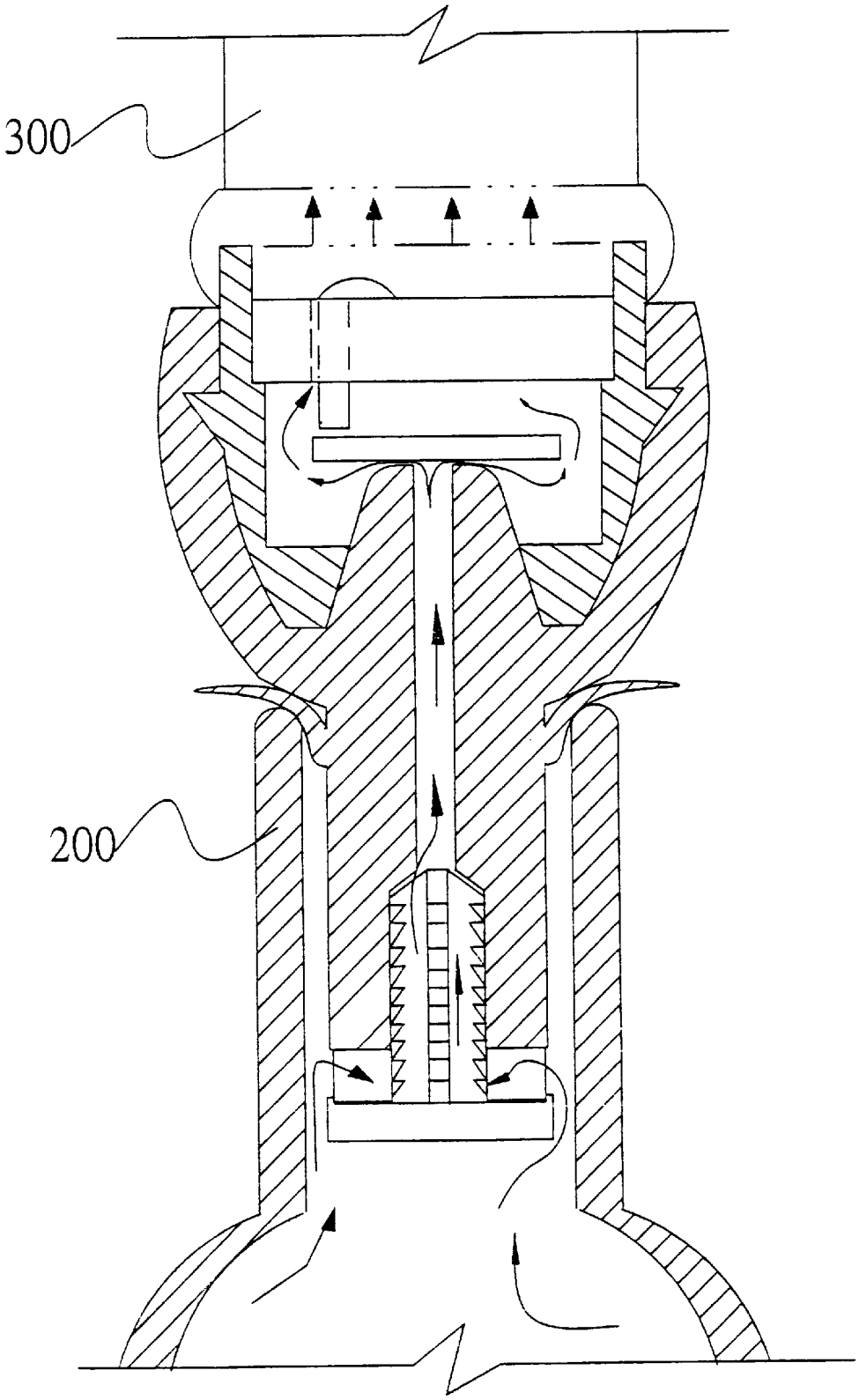
FIG. 4A shows a suction pump attached to the socket of the sealing plug cap, air drawn out of the sealing container body according to the present invention.
Figure 4B:
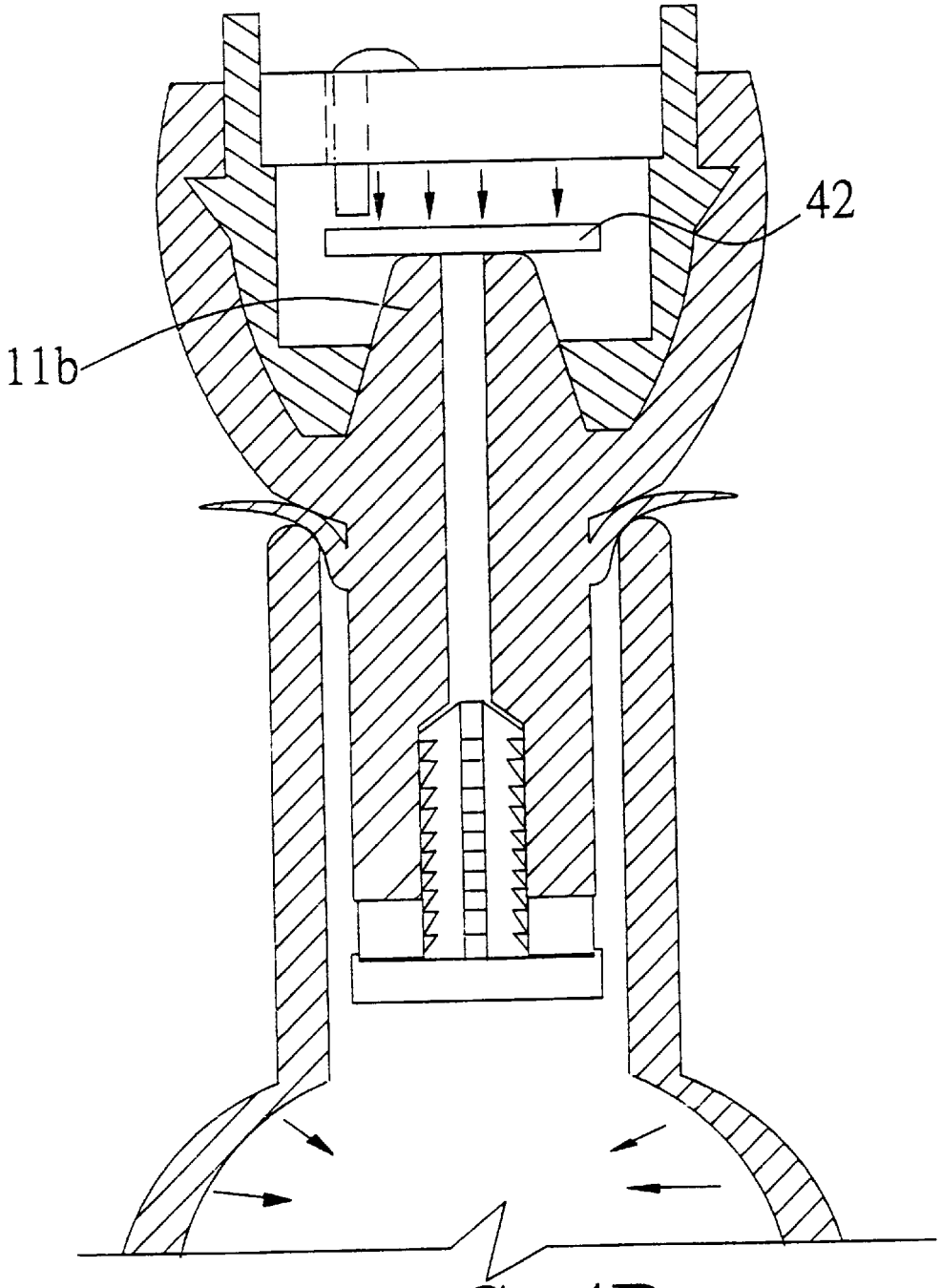
FIG. 4B shows the sealing plate closed on the cone, the air hole sealed, the peripheral flap of the plug cap body engaged with the periphery of the mouth of the sealing container according to the present invention.
Figure 4C:
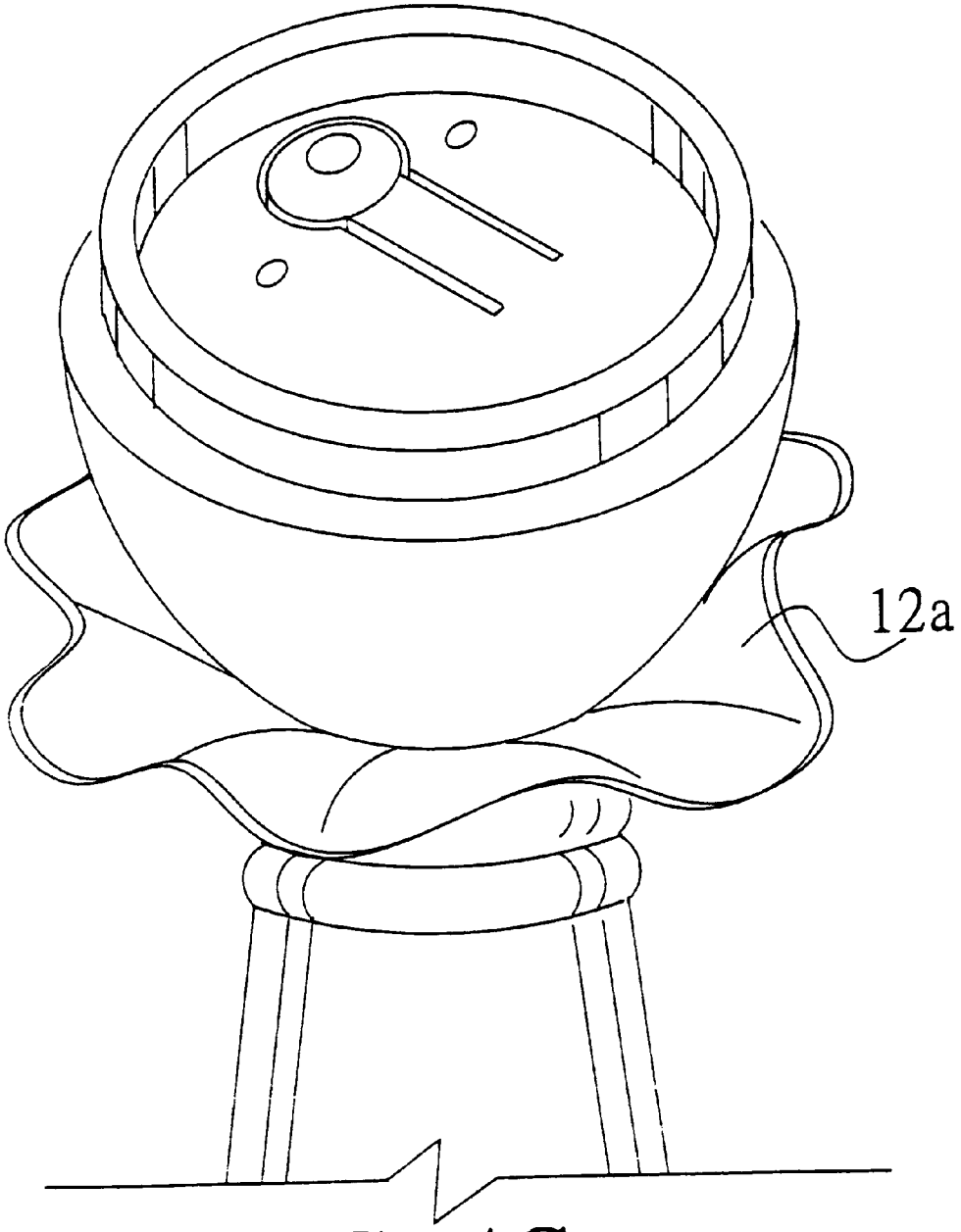
FIG. 4C is a perspective view of FIG. 3.

Referring to FIGS. 4A, 4B and 4C and FIG. 3 again, a suction pump 300 is attached to the socket 2 and operated to draw air out of the sealing container 200 (see FIG. 4A), causing the sealing container 200 to be turned into a vacuum status, and therefore the plug cap body 1, the socket 2, the air buffer device 3 and the sealing and relief control unit 4 are forced firmly together by outside air pressure (atmospheric pressure) to seal the air passage (see FIG. 4B). Because the sealing plate 42 is forced downwards by outside air pressure to close the air hole 11*c* and the peripheral flap 12*a* is forced by outside air pressure to curve inwards and to engage the mouth 200*a,* so as to close the gap between the peripheral wall of the mouth 200*a* of the sealing container 200 and the outside wall of the plug rod 12 of the plug cap body 1, the sealing container 200 is air tightly sealed. When the lever 41*a* is pressed down, the actuating rod 41*b* is lowered to press against the sealing plate 42, causing the sealing plate 42 to be tilted, enabling outside air to pass through the air hole 11*c* and the annular sponge 31 into the inside of the sealing container 200, and therefore the air pressure inside the sealing container 200 is balanced with the atmospheric pressure. When outside air passes to the inside of the sealing container 200, the air buffer device 3 effectively stops contained liquid matter from splashing out of the sealing container 200.

While only one embodiment of the present invention has been shown and described, it will be understood that various modifications and changes could be made thereunto without departing from the spirit and scope of the invention disclosed.

What the invention claimed is:

1. A sealing plug cap fastened to the mouth of a sealing container to stop the air passage of the mouth, the sealing plug cap comprising:

a plug cap body molded from flexible material and fastened to the mouth of the sealing container, said plug cap body comprising a bowl stopped above the mouth of the sealing container, a plug rod raised from said bowl and plugged into the mouth of the sealing container, a peripheral flap raised around the periphery of said plug rod and stopped outside the mouth of the sealing container, an annular groove inside said bowl, a cone raised from the center of said bowl on the inside, and an air hole pierced through the center of said cone and the longitudinal central axis of said plug rod;

a socket fitted into said bowl of said plug cap body, said socket comprising a positioning flange raised around the periphery on the middle and engaged into the annular groove inside said bowl, and a circular bottom hole at the center, which receives the cone of said plug cap body;

an air buffer device fastened to the plug rod of said plug cap body inside said sealing container, said air buffer device comprising a retainer element, said retainer element comprising a disk-like head suspended inside the sealing container and a peripherally serrated split rod perpendicularly raised from the center of said disk-like head and engaged into the air hole in the plug rod of said plug cap body, and an annular sponge mounted around the split rod of said retainer element and stopped between the plug rod of said plug cap body and the disk-like head of said retainer element; and a sealing and relief control unit mounted within said socket, said sealing and relief control unit comprising a sealing plate suspended inside said socket and supported on the cone of said plug cap body to seal said air hole, and a press block mounted inside said socket and operated to tilt said sealing plate in opening said air hole, said press block comprising a lever suspended in an opening thereon, said lever comprising an actuating rod downwardly raised from a free end thereof and moved to tilt said sealing plate when said lever is depressed by hand.

* * * * *